US009689243B2

(12) United States Patent
Morrow

(10) Patent No.: US 9,689,243 B2
(45) Date of Patent: Jun. 27, 2017

(54) PROGRESSIVE CAVITY PUMP WITH FREE PUMP ROTOR

(71) Applicant: HARRIER TECHNOLOGIES, INC., Greenwich, CT (US)

(72) Inventor: William Bruce Morrow, Santa Barbara, CA (US)

(73) Assignee: HARRIER TECHNOLOGIES, INC., Greenwich, CT (US)

( * ) Notice: Subject to any disclaimer, the term of this patent is extended or adjusted under 35 U.S.C. 154(b) by 395 days.

(21) Appl. No.: 14/254,159

(22) Filed: Apr. 16, 2014

(65) Prior Publication Data

US 2014/0311730 A1 Oct. 23, 2014

Related U.S. Application Data

(60) Provisional application No. 61/812,827, filed on Apr. 17, 2013.

(51) Int. Cl.

| | |
|---|---|
| ***E21B 43/12*** | (2006.01) |
| ***F04C 2/107*** | (2006.01) |
| ***F04C 13/00*** | (2006.01) |
| ***F04C 15/00*** | (2006.01) |

(52) U.S. Cl.

CPC ..... *E21B 43/126* (2013.01); *F04C 2/1071* (2013.01); *F04C 13/008* (2013.01); *F04C 15/0073* (2013.01); *F04C 2240/50* (2013.01)

(58) Field of Classification Search

CPC .. E21B 43/126; F04C 15/0073; F04C 13/008; F04C 2/1071; F04C 2240/50

See application file for complete search history.

(56) References Cited

U.S. PATENT DOCUMENTS

| | | | | | |
|---|---|---|---|---|---|
| 2,527,673 | A * | 10/1950 | Byram | F04C 2/1073 | 418/182 |
| 3,567,348 | A * | 3/1971 | Benson | F04C 2/1073 | 403/292 |
| 3,938,744 | A * | 2/1976 | Allen | F04C 2/1073 | 241/46.11 |
| 4,187,061 | A * | 2/1980 | Jurgens | E21B 4/02 | 175/107 |
| 4,585,401 | A * | 4/1986 | Baldenko | E21B 4/02 | 29/434 |
| 4,636,151 | A * | 1/1987 | Eppink | E21B 4/02 | 418/182 |
| 4,679,638 | A * | 7/1987 | Eppink | E21B 4/02 | 175/107 |
| 5,097,902 | A * | 3/1992 | Clark | F04C 13/008 | 166/106 |
| 5,139,400 | A * | 8/1992 | Ide | E21B 4/02 | 175/107 |
| 5,501,580 | A * | 3/1996 | Barrus | E21B 43/128 | 166/107 |
| 2002/0192093 | A1* | 12/2002 | Gantenhammer | F04C 2/1073 | 418/48 |
| 2004/0129430 | A1* | 7/2004 | Tessier | E21B 17/06 | 166/378 |

(Continued)

*Primary Examiner* — Blake Michener

(74) *Attorney, Agent, or Firm* — Ladas & Parry LLP

(57) ABSTRACT

In a production apparatus for pumping production fluid to the surface of a well, a progressive cavity pump with a stator and a rotor in which the rotor has an extension which rests on a thrust bearing, lubricated by production fluid.

8 Claims, 5 Drawing Sheets

(56) References Cited

U.S. PATENT DOCUMENTS

| | | | | |
|---|---|---|---|---|
| 2007/0253852 | A1* | 11/2007 | Weber | F04C 2/1071 418/45 |
| 2009/0032242 | A1* | 2/2009 | Zupanick | E21B 33/128 166/78.1 |
| 2012/0003112 | A1* | 1/2012 | Hayashimoto | F04C 2/1071 418/166 |
| 2012/0132470 | A1* | 5/2012 | Jarvis | E21B 4/02 175/57 |
| 2012/0199361 | A1* | 8/2012 | Zupanick | E21B 33/128 166/369 |
| 2013/0052067 | A1* | 2/2013 | Hohl | E21B 4/02 418/48 |
| 2014/0064997 | A1* | 3/2014 | Hohl | F04C 2/1073 418/1 |

* cited by examiner

PROGRESSIVE CAVITY PUMP WITH FREE PUMP ROTOR

Applicant claims the benefits of provisional application Ser. No. 61/812,827, filed Apr. 17, 2013. The present invention relates, in a general sense, to oil well production and, more particularly, to a progressive cavity pump used in such production.

BACKGROUND OF THE INVENTION

FIELD OF THE INVENTION

Progressive cavity pumps (PCP) are a commonly found as a part of an oil field artificial lift system. The system is comprised of a downhole Moyno-type progressive cavity pump driven via a rotating rod string connected to a surface drive unit.

The Moyno pump is a positive displacement pump that is particularly well suited to handling viscous and sandy fluids and was initially used in the tar sands in Canada. More recently the device has proven to be useful in an artificial lift system for many oil field producing well applications.

The typical PCP utilizes a steel rotor and a stator of elastomer material, which can allow the pump to handle abrasive material in the produced fluid. The downside of using an elastomer material is incompatibility with components in the produced fluid, such as aromatic hydrocarbons, $H_2S$, and $CO_2$.

In horizontal wells, most of the deviation occurs near the maximum vertical depth of the well, where the rod tension due to rod weight is at a minimum, and most of the tension in the rod string is due to fluid column weight. This rod tension from fluid column weight is due to the hydrostatic pressure of the fluid column acting on the pump rotor, which is attached to the rods. If the rods could be tensionally decoupled from the pump rotor, then the rod tension near the well maximum depth would be greatly reduced. However, if the rods are no longer carrying the fluid load borne by the pump rotor, that load must be carried elsewhere, e.g. the tubing via a bearing either at the top of the bottom of the pump rotor.

The rotor of the Moyno pump is attached to and rotated by the drive rod string, which extends to the surface. The drive rod string rotation is driven by a surface drive unit. A typical drive unit, or drive head, imparts rotational power to the drive string usually via an electric motor and a V-belt reduction drive. Hydraulic motor-driven drive heads are also used The drive head also has a spherical roller thrust bearing that supports the downward tension of the rod string.

In a typical modern PCP installation, the downward tension in the rod string consists of two components: the dead weight of the rod string in the well fluid, and the weight of the fluid column supported by the pump in operation. At the surface, the rod tension is the sum of the weight of the entire rod string plus the fluid column weight. At the pump location downhole, there is no tensional component of the rod weight, and the rod string tension consists of only the fluid column weight, which can be substantial.

In perfectly straight and vertical wells, the tension in the rod string is beneficial, in that it helps with drive rod rotation stability. However, in heavily deviated or horizontal wells, the tension in the rod string can lead to rod and tubing wear issues, where the rods are pulled taut through a bend in the well. The tension in the rod string is translated into a lateral force between the rod string and the inside of the bend in the tubing that will cause forceful contact between the two, resulting in wear of both components and eventual failure of one or the other, or both.

The potential wear can be reduced by using rod guides, or centralizers, that hold the rods away from the tubing wall. However, the high lateral forces are then carried by the centralizers, which eventually wear down, allowing the rods to contact the tubing. This issue of rod-tubing contact and wear limits the use of otherwise desirable PCP systems in highly deviated wells and particularly in horizontal wells.

Designing such a bearing for a progressive pump is problematic, as the motion of the rotor is not concentric around a single axis, but involves the axis of rotation of the rotor itself orbiting a point in the center of the stator, that orbital direction being the opposite to that of the pump rotor rotation (e.g., counterclockwise if the rotor is turning clockwise). This "wobble" makes the use of a conventional lubricated thrust bearing difficult, as the shaft connecting the bearing to the rotor cannot be easily sealed.

Various methods have been attempted, including a drive shaft equipped with two universal joints connecting the bearing with the rotor, a flexible shaft between the two components, and various connectors that allow relative axial misalignment between the rotor and the bearing input shaft. All methods require bearings that are sealed from the well fluid and provided with clean lubricant.

SUMMARY OF THE INVENTION

It is the principal objective of the current invention to provide a system to isolate the PCP pump rotor from the drive rod string without the need for a complicated linkage between the thrust bearing and the pump rotor. The system also utilizes a thrust bearing that does not need to be isolated from the produced fluids, nor provided with clean lubrication.

Other objects and advantages of the present invention will become clear to those skilled in the art, upon a reading of the following detailed description of a preferred embodiment taken in conjunction with the drawings, wherein:

BRIEF DESCRIPTION OF A PREFERRED EMBODIMENT

Figure 1:
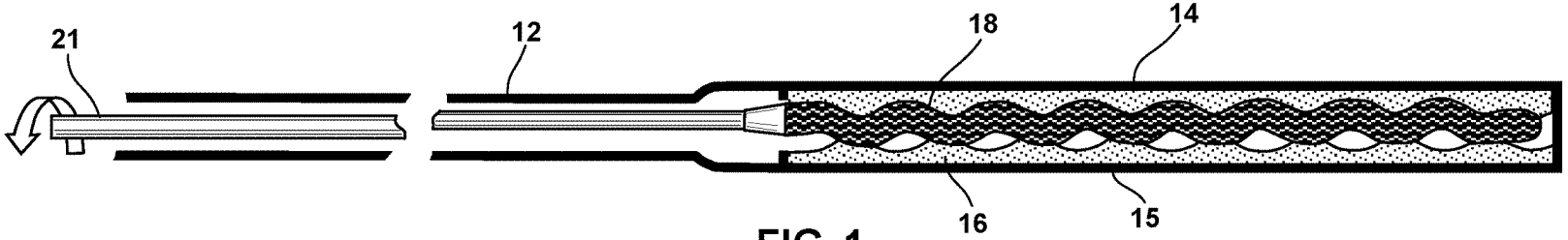
FIG. 1 is a pictorial representation of an existing typical progressive cavity pump (PCP) system.
Figure 2:
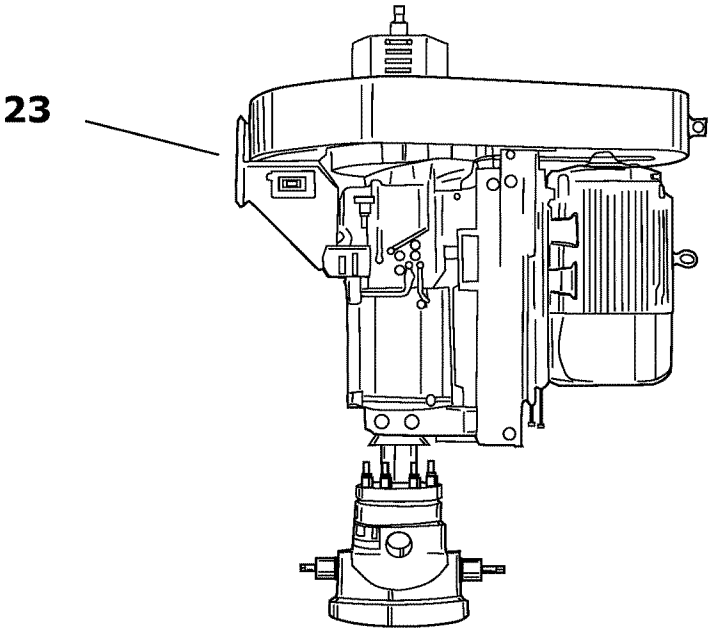
FIG. 2 is a pictorial representation of a modern PCP drive assembly, or head, which reposes on the surface of the earth and drives the rod string which drives the PCP.

In order, first, to provide a perspective on the current process in general use in the oil industry and thereby gain an appreciation for the present invention, refer first to FIG. 1 which illustrates the current state-of-the-art in the oil industry, for at least a part of the down hole PCP system. Illustrated there is the lower portion of the production tubing 12 to which is attached the Moyno pump assembly 14. The pump assembly 14 includes a stator section 16 and a rotor section 18 within a tubular housing 15. The rotor section 18 is driven by a rod string 21. The rod string 21 attaches to and is driven by a drive head 23 at the surface, a typical one of which is illustrated in FIG. 2.

Figure 3:
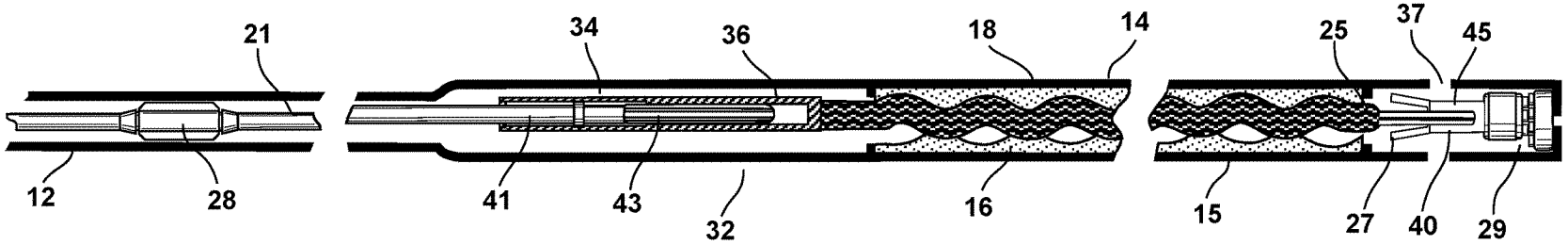
FIG. 3 is illustrative of the free rotor PCP system with the thrust bearing in place at the low end of the rotor.

Referring next to FIG. 3, the same portion of the production tubing 12 is shown, but with a novel free-rotor PCP system, illustrated as an improvement in the FIG. 1 system. It will be quickly appreciated that the remote end 25 of the rotor 18 is affixed with a splined extension 45, which mates with a splined female receiver 36. Splined female receiver 36 is fixedly attached to a thrust bearing assembly 29. Splined female receiver 40 is equipped with a stab-in guide 27 to assure that the pump rotor splined extension 45 is properly seated in the receptacle at installation.

Returning to FIG. 3, there is shown the components of the current invention, the free-rotor progressive cavity pump 32, constructed in accordance with the present invention.

The system consists principally of a Moyno pump 14, with a rotor 18, stator 16 and pump housing 15, and fluid intakes 37, similar to the typical downhole PCP pump, driven by a rotating rod string 21, with rod rotation stabilizer 28. Unlike the pump in FIG. 1, however, the rotor 18 is not fixedly attached to the drive rod string 21. Instead, it is important to note that there is a captured spline drive assembly 34, between the drive rod string 21 and the pump rotor 18 that connects the rod string 21 and rotor 18 in torsion, but not in tension (FIG. 4).

Figure 4:
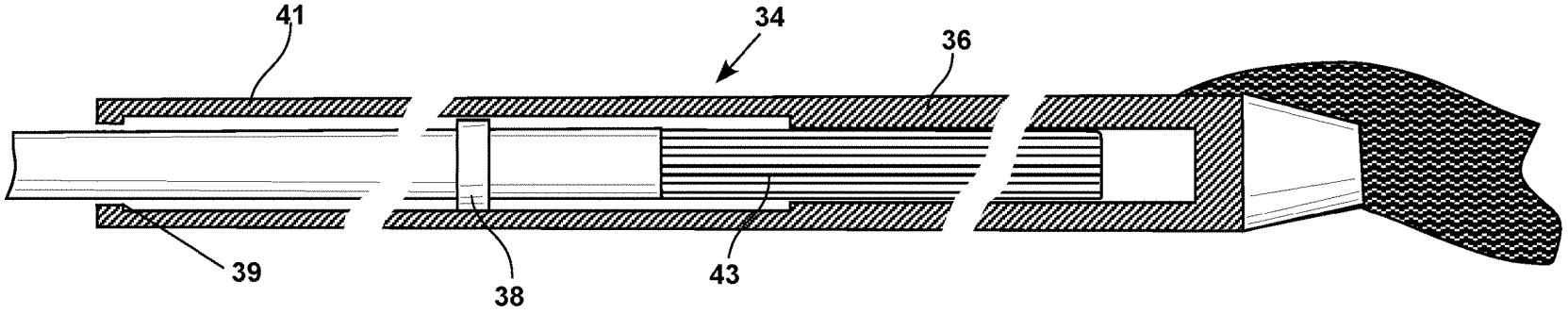
FIG. 4 is a pictorial representation of the captured spline drive assembly of FIG. 3.

This captured-spline drive assembly 34 allows the drive rod string 21 to rotate the pump rotor 18 via a drive rod string extension 41 with male splined end 43, and the mating splined female receiver 36 in the captured spline drive assembly 34 housing, as shown in FIG. 4. The drive rod string extension 41 has freedom to move axially within the captured spline drive assembly 34. The axial displacement of the drive rod string extension 41 within the captured spline drive assembly 34 is limited by the collet 38 fixedly attached to the drive rod string extension 41, and the stop 39 at the uphole end of the captured spline drive assembly 34, which keeps the drive rod string extension 41 and captured spline drive assembly 34 from separating and the male splined end 43 and splined female receiver 36 engaged.

Figure 5:
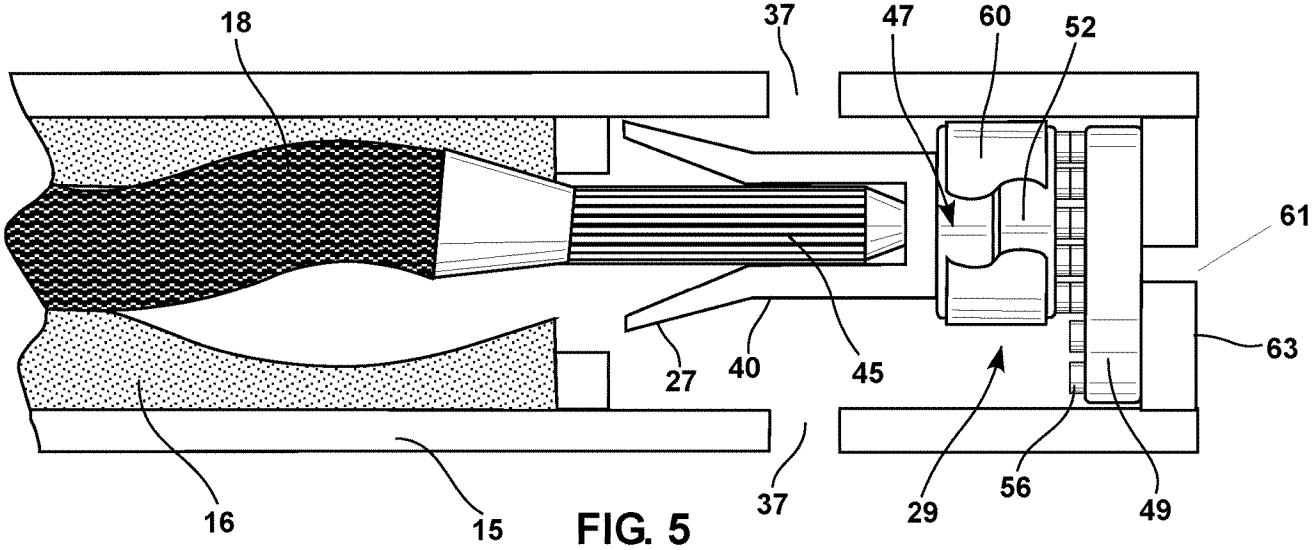
FIG. 5 is, again, a pictorial representation of the lower end of the drive string pump as seen in FIG. 3, detailing the thrust bearing assembly and the pump rotor attachment thereto.

In keeping with the invention and referring to FIG. 5, at the bottom of the free-rotor PCP assembly is the thrust bearing assembly 29. As discussed above, since the pump rotor 18 is not fixedly attached to the drive rod string 21, the fluid load supported by the pump rotor 18, and normally carried by the drive rod string 21 and a thrust bearing in the drive head 23, must be handled by a thrust bearing elsewhere in the system. In keeping with the objectives of the present invention, that thrust bearing is located in the downhole end of the pump housing 15, and transfers the pump rotor's 18 downward thrust load from the pump rotor 18 to the pump housing 15, and hence to the production tubing 12.

The thrust bearing assembly 29 is engaged by the pump rotor 18 via the thrust bearing drive spline 45, fixedly attached to the downhole end of the pump rotor 18, and a stab-in assembly, consisting of a conical stab-in guide 27, a female spline receiver 36, and the stab-in base plate 47 (FIG. 5).

The thrust bearing assembly 29 consists of a lower thrust bearing plate 49, and an upper thrust bearing plate 52 (FIG. 5). The main bearing elements of the assembly are the Poly-Crystalline Diamond (PCD) "buttons" 56 imbedded into each of the two PCP thrust bearing plates 49 and 52. These buttons bear on one another and are lubricated by the produced fluid. A grease shroud 60 isolates the contact surface between of the stab-in base plate 47 and the upper thrust bearing plate 52, to protect this greased contact surface from well fluid contamination.

Figure 8:
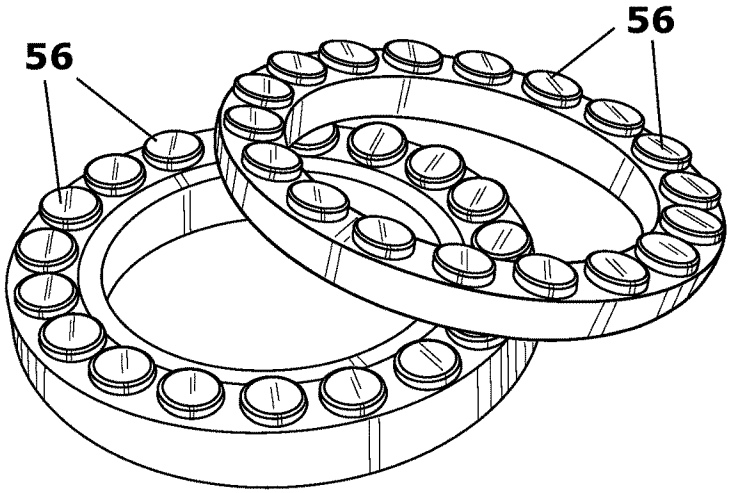
FIG. 8 is a pictorial representation of a commercially available PCD thrust bearing; and, FIG. 9 is a pictorial representation of the movement of the pump rotor as it moves relative to the thrust bearing of the present invention.
Figure 9:
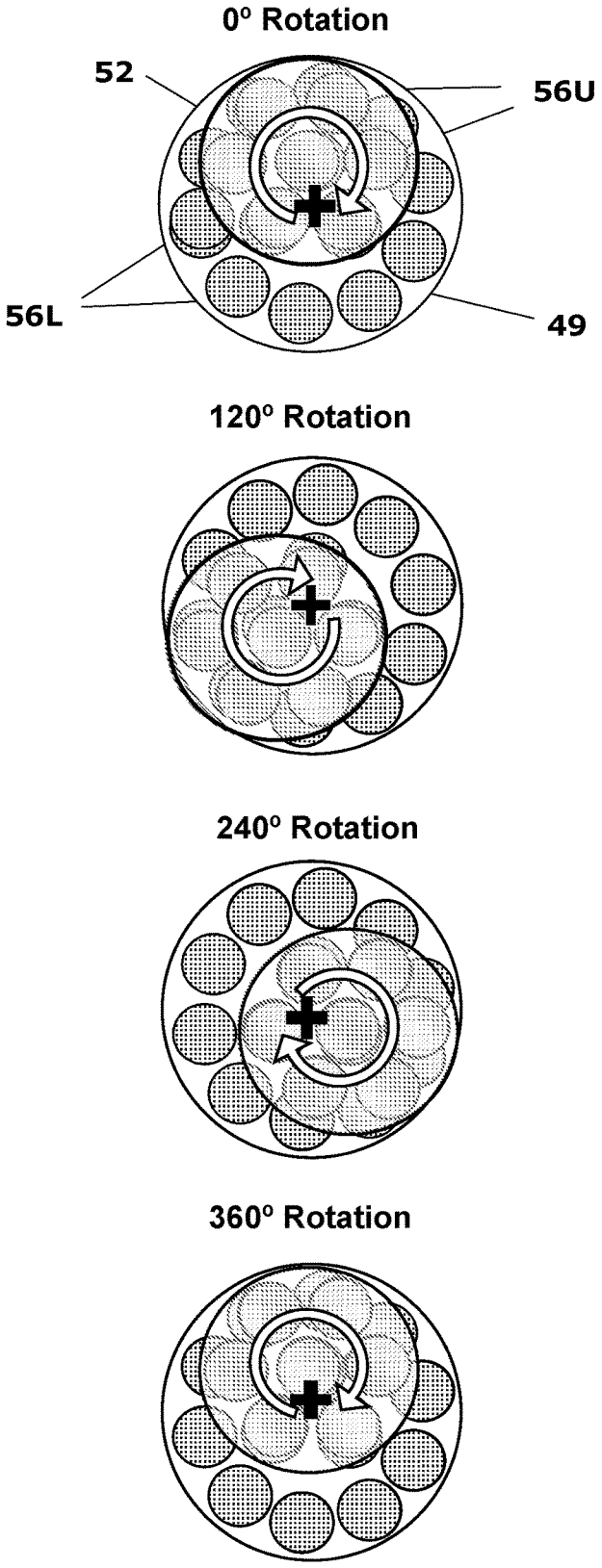

The configuration of a PCD thrust bearing normally used in industrial applications is shown in FIG. 8, where the buttons are confined to a single row at the periphery of the equal diameter mating bearing plates. This configuration is designed for a concentric rotation of the thrust load. In keeping with the current invention, however, the rotation of the pump rotor 18 is not concentric, and the upper thrust plate 52 does not rotate around a single center, as is shown in FIG. 9. For the buttons 56U of the upper thrust bearing plate 52 to continuously bear on mating buttons 56L on the lower thrust bearing plate 49, more than just the periphery of the bearing plates need to be equipped with PCD buttons. This is quite clearly shown in FIG. 9, and a typical PCD button arrangement on the two thrust bearing plates 49 and 52 is shown in perspective in FIG. 6. The PCD buttons 56L on the lower thrust bearing plate 49 cover the entire area swept out by the eccentric motion of the upper thrust bearing plate 52, providing continuous contact between all the buttons 56U on the upper thrust bearing plate 52 with buttons 56L on the lower thrust bearing plate 49.

Note the cooling water port 58 through the center of the lower thrust bearing plate 49. This port mates with a similar port in the bottom of the pump housing 61 (FIG. 5) that allows produced fluid to enter the thrust bearing area and lubricate and cool the PCD buttons.

Figure 7:
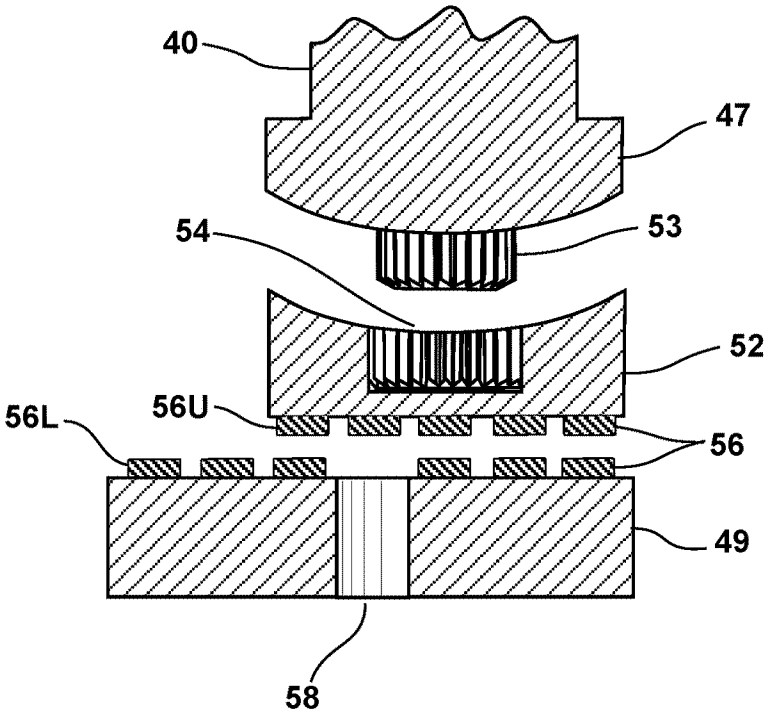
FIG. 7 is a partial cross-sectional view of the thrust bearing drive assembly shown pictorially in FIG. 6

In order, in accordance with the invention, for PCD thrust bearings 56 to function properly, the flat bearing surfaces 63 (FIG. 6) of mating buttons, 56U and 56L must be parallel. Angular misalignment between the two thrust bearing plates 49 and 52 would lead to reduced contact between mating PCD buttons, uneven and premature wear, overheating of the buttons, and excessive frictional losses. In the current invention, the lower thrust bearing plate 49 is held fixed and aligned with respect to the pump housing 15. The upper thrust bearing plate 52, however, is attached to the pump rotor 18 by the female spline receiver 36 and the thrust bearing drive spline 45. The pump rotor 18 turns eccentrically, and typically within a flexible elastomer stator 16, creating a situation not conducive to perfect and unchanging alignment between the upper and lower thrust bearing plates 52 and 49, respectively. This potential misalignment of the upper and lower thrust bearing plates 52 and 49 is eliminated by providing the upper thrust bearing plate 52 with freedom of limited angular movement in all directions so that it can self-align with the lower thrust bearing plate 49. The thrust bearing assembly 29 provides this alignment between the upper and lower thrust bearing plates 52 and 49, as shown in FIGS. 6 and 7.

Figure 6:
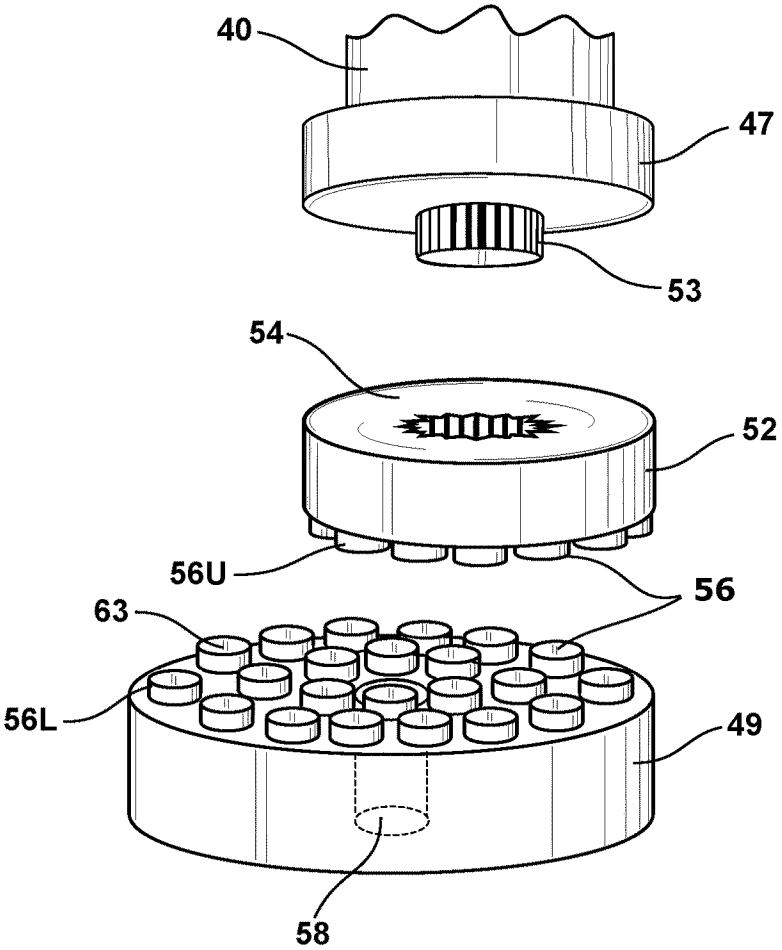
FIG. 6 is an exploded pictorial representation of the thrust bearing drive assembly of the present invention.

Referring to FIG. 6, the thrust bearing assembly 29 consists of an upper thrust plate 47, attached to the downhole end of the female spline receiver 36. The bottom surface of thrust plate 47 is spherically convex shaped. Protruding from the center of the convex bottom surface of thrust plate 47 is a coarse male spline stub 53. The upper surface of the upper thrust bearing plate 52 is spherically concave, with the mating curvature to that of the convex lower surface of thrust plate 47. A female splined bore 54 is centered in upper thrust bearing plate 52, with spline configuration to mate with the coarse male spline stub 53. The fit of coarse male spline stub 53 into female splined bore 54 is not tight, to accommodate some lateral and angular misalignment, yet remain is driving connection. Lower thrust bearing plate 49 is fixedly attached to the assembly housing base 63. The FIG. 6 thrust bearing assembly 29 is shown in cross-section as FIG. 7. The expected torque loads on the coarse spline stub 53 and the female splined bore 54 are not excessive, due to the low coefficient of friction between PCD surfaces, so the less-than-perfect fit of the respective splines should not cause excessive wear.

Having now described the various elements that make up the structure of the present invention, its operation is as follows:

The free-rotor PCP is installed in a well similarly to a conventional PCP. The pump 14 (housing with stator) and the thrust bearing assembly 29 are run on the production tubing 12 to the desired depth within the well. The rotor 18 with stab-in spline 45 and captured spline drive assembly 34 is run in the production tubing 12 on the drive rod string 21. The rotor 18 is run into the pump stator 16 until the stab-in spline 45 is landed and engaged in the stab-in receiver 40. This will result in the captured spline drive assembly 34 being fully collapsed, with the male splined end 43 inserted fully into the splined female receiver 36. The rods are then pulled about one foot out of the production tubing 12. This will result in one foot of disengagement of the spline in the captured spline drive assembly 34, but will leave the stab-in spline 45 in the fully engaged position with the female stab-in receiver 40, as the friction between the pump rotor 18 and stator 16 will hold the rotor 18 and stab-in spline 45 in place. The rotor 18 is fully engaged with the rod string in torsion via the captured spline drive assembly 34, but is free of any tension connection with the rods. The drive head is then installed and the pump started.

It will be appreciated as well by those skilled in the art upon reading this detailed description may think of some variations in structure and form, such variations are within the contemplation of the invention as described and claimed in the following:

The invention claimed is:

1. A pumping system in a production well for raising a production fluid from a subterranean production fluid deposit to the surface of the well, the pumping system comprising:

a progressive cavity pump;

a rod drive string, the rod drive string operating in a tube and being connected to the progressive cavity pump, said pump including a rotor, a stator circumscribing said rotor, said rotor affixed to a splined extension; and an unsealed thrust bearing connected to the splined extension of the progressive cavity pump rotor, wherein said thrust bearing has a lower thrust plate and an upper thrust plate smaller than the lower thrust plate, and wherein said production fluid lubricates said thrust said thrust bearing.

2. The assembly of claim 1, wherein said splined extension is received in a stab-in guide, said stab-in guide extending upwardly from said thrust bearing to impart rotational movement to at least a portion of said thrust bearing assembly.

3. The assembly of claim 2, wherein said upper thrust bearing plate is rotated by said stab-in guide and eccentric to said larger lower thrust bearing.

4. The assembly of claim 2 wherein said stab-in guide has a base plate.

5. The assembly of claim 4, wherein said base plate and said upper thrust bearing plate are connected with a spline connection.

6. The assembly of claim 5, wherein the spline connection between the base plate and the upper bearing thrust plate permits angular movement in all directions so that the upper bearing thrust plate can align with the lower bearing thrust plate.

7. The pumping system of claim 1, wherein said thrust bearing further comprises poly-crystalline diamond (PCD) buttons embedded in the upper and lower thrust plates.

8. A pumping system in a production well for raising a production fluid from a subterranean production fluid deposit to the surface of the well, the pumping system comprising:

a production tubing, said production tubing having an upper and a lower end;

a progressive cavity pump, said pump consisting of a housing, said housing having an upper and a lower end, a stator inside of said housing, a rotor having an upper and a lower end, said rotor being circumscribed by said stator, said progressive cavity pump attached to the lower end of said production tubing;

a splined extension affixed to the lower end of said rotor;

an unsealed thrust bearing, said thrust bearing consisting of a lower thrust plate affixed inside of and at the lower end of said housing, and an upper thrust plate smaller than said lower thrust plate, wherein the motion of the upper thrust plate relative to the lower thrust plate is eccentric rotation, and wherein said production fluid lubricates said thrust bearing;

a stab-in guide, said stab-in guide extending upwardly from the said upper thrust plate of said thrust bearing, said stab-in guide receiving said splined extension to impart rotational movement to said upper thrust bearing plate;

a drive rod string situated within said production tubing said drive rod string having an upper and a lower end;

a captured spline assembly disposed between the lower end of said drive rod string, and said progressive cavity pump, said captured spline assembly having an upper and a lower end, said upper end fixedly attached to the lower end of said drive rod string, said lower end fixedly attached to said upper end of said progressive cavity pump rotor;

a rotational prime mover situated at the upper end of the production tubing, said rotational prime mover attached to said upper end of said drive rod string for the purpose of rotationally driving said drive rod string;

wherein said progressive cavity pump requires the input of rotational power into said progressive cavity pump rotor for pumping operation;

wherein said captured spline assembly provides a torsional and tensional connection between said drive rod string and said progressive cavity pump rotor, said captured spline assembly providing limited relative vertical movement between said drive rod string and said rotor while maintaining a torsional and tensional connection between said drive rod string and said rotor;

wherein said captured spline assembly comprises upper and lower portions, said upper portion being slidably and torsionally connected to said lower portion to provide limited relative axial movement between said portions while maintaining torsional connection, said relative axial movement comprising either compressional movement, wherein said upper and lower portions move toward one another, or extensional movement, wherein said upper and lower portions move away from one another; and wherein said extensional movement is mechanically limited, and at the limit of said extensional movement, said upper and lower portions of said captured spline assembly are in tensional connection, wherein said compressional movement is mechanically limited, and at the limit of said compressional movement, said inner and outer portions of said captured spline assembly are in compressional connection.

* * * * *